US006449804B1

(12) United States Patent
Van Doorn

(10) Patent No.: US 6,449,804 B1
(45) Date of Patent: Sep. 17, 2002

(54) RIGID CAGE COTTON GIN

(75) Inventor: Donald W. Van Doorn, Savannah, GA (US)

(73) Assignee: Lummus Corporation, Savannah, GA (US)

( * ) Notice: Subject to any disclaimer, the term of this patent is extended or adjusted under 35 U.S.C. 154(b) by 0 days.

(21) Appl. No.: 09/852,925

(22) Filed: May 9, 2001

(51) Int. Cl.[7] ..... D01B 1/04
(52) U.S. Cl. ..... 19/48 R; 19/39; 19/64.5
(58) Field of Search ..... 19/39–47, 48 R, 19/49–59, 64.5

(56) References Cited

U.S. PATENT DOCUMENTS

| | | | | |
|---|---|---|---|---|
| 4,441,232 A | | 4/1984 | Underbrink et al. | |
| 4,890,357 A | * | 1/1990 | Pinto et al. | 19/64.5 |
| 4,934,029 A | | 6/1990 | Wilkes et al. | |
| 4,984,334 A | | 1/1991 | Wilkes et al. | |
| 5,003,669 A | | 4/1991 | Wilkes et al. | |
| 5,392,495 A | * | 2/1995 | Horn | 19/48 R |
| 5,412,844 A | * | 5/1995 | Horn et al. | 19/40 |
| 5,740,588 A | | 4/1998 | Strick | |
| 6,088,881 A | | 7/2000 | Van Doorn et al. | |

* cited by examiner

*Primary Examiner*—Danny Worrel
*Assistant Examiner*—Gary L. Welch
(74) *Attorney, Agent, or Firm*—Christopher A. Holland; Robert J. Veal; Burr & Forman LLP

(57) ABSTRACT

A rigid cage cotton gin includes a feeder that delivers seed cotton locks to be ginned. A doffing cylinder at the discharge of the feeder casts seed cotton locks into a bonnet housing, with air inlet vents in the bonnet housing deflecting the seed cotton locks onto a revolving rigid cage having a series of sifting bars that are fixedly mounted thereto. The sifting bars are spaced-apart to define a series of slots. The rigid cage is rotated for seed cotton locks to be drawn to the slots between the sifting bars, and the fibers will be drawn through the slots by air currents flowing through the slots. A fiber-engaging cylinder is mounted within the rigid cage, with the outer surface of the fiber-engaging cylinder abutting the interior surfaces of the sifting bars. The sifting bars are contoured to restrain the cotton seed from moving closer than a predetermined distance from the surface of the fiber-engaging cylinder to control the minimum fiber length removed. The outer surface of fiber-engaging cylinder has a very high coefficient of friction against cotton fibers, but a relatively low coefficient of friction against the inside surfaces of the sifting bars for the fiber-engaging cylinder to draw the desired fibers away from the cotton seed.

26 Claims, 4 Drawing Sheets

RIGID CAGE COTTON GIN

FIELD OF THE INVENTION

The present invention relates to the field of removing cotton fibers from cotton seed or cotton ginning. More particularly, the invention relates to an apparatus and method for efficiently separating the desired cotton fibers from the cotton seed without nepping or fracturing of the cotton fibers.

BACKGROUND OF THE INVENTION

In the art of cotton ginning, there are two prominent ginning assemblies that are currently employed, with those ginning assemblies being saw gins and roller gins. The most prevalent ginning method is the saw gin, with the basic concept for the saw gin dating back to Eli Whitney. The saw gin provides an expeditious method for removing the fibers from the seeds, but it suffers from several problems. First, the saw gin generates a significant amount of undesirable fiber breakage. Additionally, "nepping" (small knots of entangled fibers) commonly occurs during the ginning of cotton with a saw gin. Moreover, another problem experienced with the saw gin is that machine picked cotton often includes a great deal of fine trash in the seed cotton, and the saw gin further breaks up and mixes this fine trash in the cotton. Consequently, it is difficult to remove this fine trash from the cotton. Furthermore, textile mill spinning processes are becoming more sophisticated, thereby demanding even cleaner cotton with less fiber breakage and nepping.

The second popular ginning apparatus is the roller gin, which is well known to persons having ordinary skill in the art. The roller gin is used in some areas because it breaks fewer fibers, produces fewer neps, and produces less fine trash than the conventional saw gin design. However, the roller gin operates slowly, and it is an expensive solution for ginning cotton. Consequently, it does not satisfactorily solve the problems experienced by the saw gin.

Several additional designs have attempted to address the problems present in these two current gin designs. For example, U.S. Pat. Nos. 4,441,232, 4,934,029, 4,984,334, and 5,003,669 disclose various cotton gin designs (commonly referred to as "cage gins") that attempt to improve the quality of the cotton fibers treated. These cage ginning concepts employed multiple idler rollers having a diameter of approximately 0.75 inches that were placed around the perimeter of a squirrel cage parallel to the cage axis approximately 0.100 inches apart. A series of rubber covered nip rollers were further mounted inside the cage parallel to the cage axis and were pressed against the interior sides of the idler rollers to firmly grip and spin the idler rollers sequentially as the squirrel cage frame was revolved. The rubber covered nip rollers of this prior art had a very high coefficient of friction against both the cotton fibers and also against the idler roller surfaces as the object of each of these prior art designs was to instantaneously grip and spin the idler rollers at the same surface speed as the nip rollers when the rubber covered nip rollers contacted the idler rollers as the cage revolved. While this apparatus provided an improved cotton fiber quality as compared to the conventional methods for ginning cotton described above, the impact and sudden acceleration of the idler rollers against the rubber covered nip rollers caused undesirable and unacceptable bearing failures of the necessarily small bearings at the ends of the closely spaced idler rollers. Even with the small 0.75 inch diameter cage rollers that caused sever bearing failures the seed were unable to come closer than 0.70 inches from the nip point between the 0.75 inch diameter idler rollers and the rubber covered nip rollers. This prevented the roller cage gin from removing enough of the desirable fibers from the seeds and further made the roller cage concept impractical. Additionally, these prior art cage-type gins employing small idler rollers in the cage had the further limitation that the cage rollers and nip rollers could only have momentary line contact as the cage revolved. There are two substantial disadvantages of this design. First, the very narrow line of contact between the cage and nip rollers provided only limited gripping force, and therefore required greater force to be applied by the nip rollers against the cage rollers further contributing to cage roller bearing failures. Second, the momentary line contact between the nip and cage rollers made it necessary to rotate the cage very slowly to remove a significant amount of fiber even with multiple nip rollers. While these attempts may in theory offer improvements over current ginning methods, they do not provide a practical ginning operation.

What is desired, then, and not found in the prior art, is a cotton gin that is able to gin at competitive capacities while better preserving the quality of the cotton fiber.

SUMMARY OF THE INVENTION

An object of the present invention is to provide a cotton ginning apparatus that breaks fewer fibers than conventional ginning methods.

A further object of the present invention is to provide a cotton ginning apparatus that creates fewer neps than conventional cotton gins.

An additional object of the present invention is to provide a cotton ginning apparatus that results in fewer particles of trash, such as pepper trash and fine trash, in the ginned lint than conventional cotton gins.

A further object of the present invention is to provide a cotton ginning apparatus having a significantly higher ginning rate than conventional roller gins and sufficiently high capacity to be competitive with saw gins.

An additional object of the present invention is to provide a cotton ginning apparatus that removes fewer short fibers from the seed than conventional cotton gins.

A yet further object of the present invention is to accomplish the above objectives with apparatus whose benefits outweigh its cost.

The rigid cage cotton gin of the present invention includes, in a preferred embodiment, a cotton lock feeder that delivers seed cotton locks that are to be ginned. A high-speed doffing cylinder is mounted proximate the seed cotton feeder to cast the individualized seed cotton locks into a bonnet housing. The bonnet housing includes a series of adjustable air inlet vents in a covering and sidewall that provide airflow to physically deflect the seed cotton locks downwardly into a revolving cage chamber having spaced-apart, annular support rings or discs. A series of sifting bars are fixedly mounted to the support rings, with the adjacent sifting bars being spaced apart to define a series of slots. As a result, the seed cotton locks are drawn to the outer surface of the sifting bars via the airflow passing through the inlet vents into the rigid cage through the slots.

The present invention additionally includes a fiber-engaging cylinder that is mounted within the rigid cage, with the fiber-engaging cylinder rotating in a second direction opposite the rotation of the rigid cage. The outer perimeter of the fiber-engaging cylinder abuts the interior surfaces of the fixedly mounted sifting bars. The outer surface of fiber-engaging cylinder has a very high coefficient of friction against cotton fibers, but a relatively low coefficient of friction against the inside surfaces of the sifting bars. This low coefficient of friction results from a combination of a special fibrous surface on the fiber-engaging cylinder and the polished inner surfaces of the sifting bars. More specifically, cotton fibers cling vigorously to other fibrous surfaces whereas certain fibrous surfaces have a low coefficient of friction against polished metal surfaces. Such an arrangement allows the fiber-engaging cylinder to draw the desired fiber away from the seed cotton locks.

The present invention additionally includes a blocking cylinder that has a series of fin projections mounted external of the rigid cage proximate the exterior perimeter of the fiber-engaging cylinder. The blocking cylinder rotates in the first direction corresponding to the rigid cage, thus the fins move opposite to the surface of the cage at their point of closest proximity. The position of the blocking cylinder is adjustable with respect to the outside surfaces of the sifting bars. The fin projections of the blocking cylinder engage the seed cotton locks that are projecting above a predetermined distance from the outside surfaces of the sifting bars, especially the seed cotton locks with fibers not firmly clamped between the fiber-engaging cylinder and the inside surfaces of sifting bars. The fin projections thereby engage the loose seed cotton locks at the ginning point to knock them back into the bonnet housing for the seed cotton locks to have another opportunity to engage the slots between the sifting bars prior to reaching the ginning point as the cage rotates.

Additionally, a finned clearer cylinder may be mounted within the rigid cage following the ginning point to aid in discharging seed from the rigid cage. The clearer cylinder includes a series of clearer fins that extend from the perimeter of the finned clearer cylinder. The clearer fins enter the slots of the rigid cage and project radially beyond the narrowest point of the slots to eject foreign objects wedged between adjacent sifting bars. The fins are spaced to successively engage the slots in a gear-like manner. The ginned seed and foreign matter will then fall down onto an inclined surface to be discharged.

These and other objects and advantages of the invention will become apparent from the following detailed description of the preferred embodiment of the invention.

BRIEF DESCRIPTION OF THE DRAWINGS

A rigid cage cotton gin embodying the features of the present invention is depicted in the accompanying drawings which form a portion of this disclosure and wherein.

DESCRIPTION OF THE PREFERRED EMBODIMENTS

Figure 1:
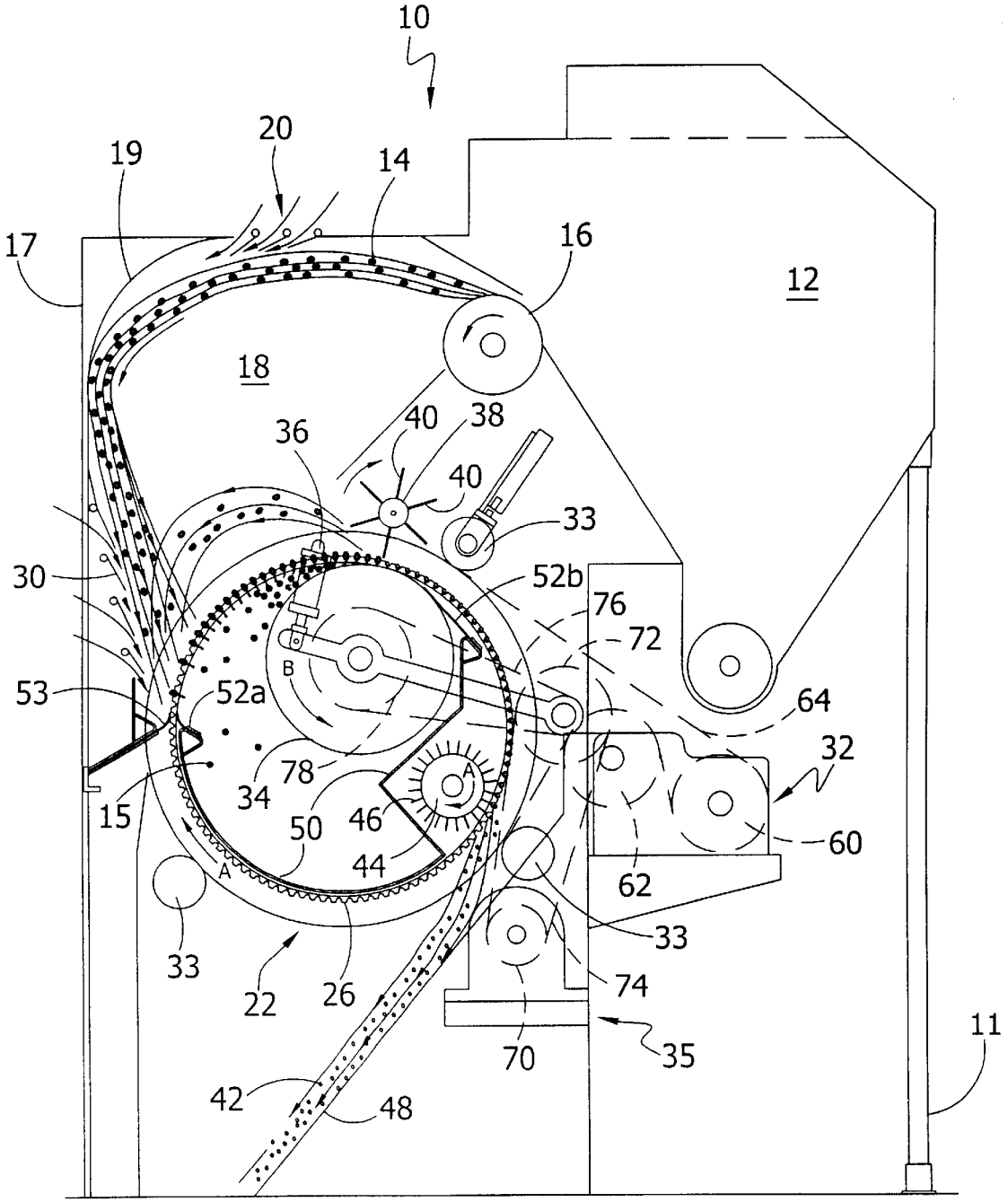
FIG. 1 is a sectional right-side view of a preferred rigid cage cotton gin employing the principles of the present invention.

While the present invention may take various forms, the preferred embodiment is shown in the cross-sectional view of the rigid cage cotton gin 10 in FIG. 1. The rigid cage cotton gin 10 includes a seed cotton feeder 12 supported by pole 11. The seed cotton feeder 12 holds seed cotton locks 14 (having cotton fibers 15 surrounding cotton seeds 42 (see FIG. 2)) that are to be ginned. As a result, the desirable cotton fibers 15 are to be detached from the cotton seeds 42. The seed cotton feeder 12 organizes the seed cotton locks 14 in a single lock condition and discharges the seed cotton locks 14 via a high-speed doffing cylinder 16. The high-speed doffing cylinder 16 acts as a feeding means for casting the individualized seed cotton locks 14 into a bonnet housing 18 having an outer wall 17 and a covering 19.

Referring to FIG. 1, the covering 19 of the bonnet housing 18 includes a series of adjustable air inlet vents 20 that bleed in air and physically deflect the seed cotton locks 14 downwardly into a revolving cage chamber 22 as the seed cotton locks are thrown into the bonnet housing 18. The air movement is caused by sub atmospheric air pressure inside a rigid cage 24, which will be discussed further herein. In addition, a series of louvers 30 are positioned on the covering 19 of the bonnet housing 18, with the louvers 30 additionally controlling a second flow of air. Consequently, the seed cotton locks 14 are further influenced by fluid air currents provided into the bonnet 18 through the louvers 30.

Looking at the FIG. 1, as the seed cotton locks 14 travel downward due to gravity and the influence of the air currents and vents 20, 30 in the bonnet housing 18, the seed cotton locks 14 are drawn to the surface of the rigid cage 22, which includes cage support rings or discs 24 and a series of sifting bars 26, which is rotated in a first direction A. The rigid cage 22 acts as a cylindrical sieve, using the sifting bars 26 that are mounted within the support rings 24. More particularly, the sifting bars 26 are in a spaced apart position within the support rings 24 to define a series of slots 28 (see FIGS. 2 and 3). The cross-section of each sifting bar 26 is preferably substantially trapezoidal, such that the sides of adjacent sifting bars 26 in the rigid cage 22 form a recessed area to couple the seed cotton lock 14. Furthermore, the air currents are allowed to pass through the slots 28 of the rigid cage 22 between the sifting bars 26 when the slots 28 are not blocked by seed cotton locks 14. The partial blocking of the slots 28 forces the air currents to flow to the unblocked areas which in turn causes the entering seed cotton locks 14 to be drawn to the open area slots 28.

A primary driving assembly 32 causes the rotation of the support rings 24 of the rigid cage 22 in the first direction as illustrated in FIG. 1, with the support rings 24 of the rigid cage 22 being held in position by a plurality of idler rollers 33. While multiple, embodiments of the primary driving assembly 32 may be implemented to drive the support rings 24, the primary driving assembly 32 of the preferred embodiment includes a motor driven gear box 60 that is connected to a primary belt 64. Moreover, the primary belt 64 extends from the motor driven gear box 60 over the edge of the support ring 24 of the rigid cage 22 and around an idler 62 to generate the desired speed of rotation of the rigid cage 22. When the rigid cage 22 is in rotation, the air currents will draw individual seed cotton locks 14 into the slots 28 between the sifting bars 26. Consequently, some of the fibers 15 on the seed cotton locks 14 will be at least partially drawn through the slots 28 between the sifting bars 26 as illustrated in FIG. 2.

Figure 2:
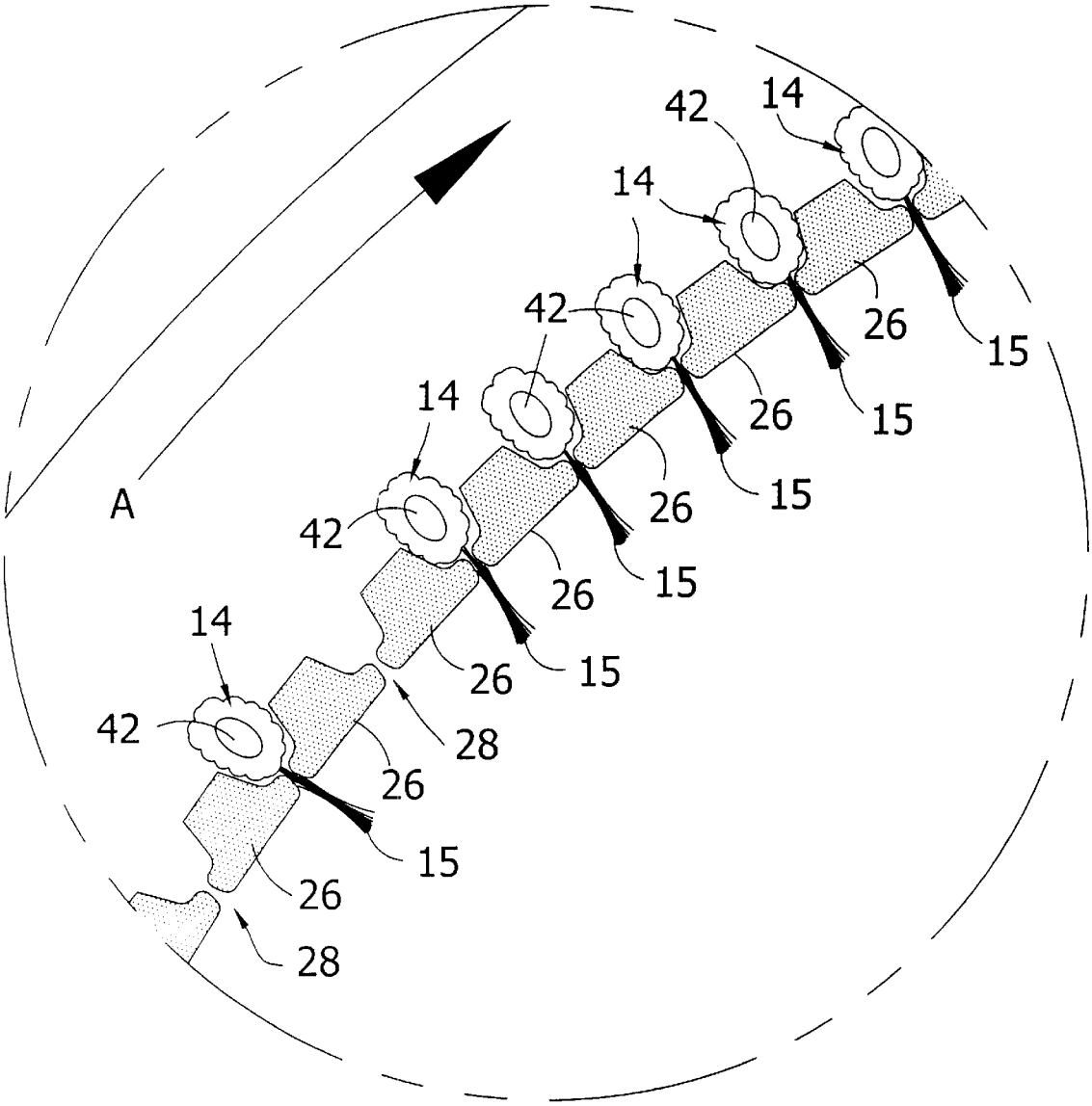
FIG. 2 is an enlarged sectional right-side view of the upper left portion of the revolving cage illustrating the initial deposition of seed cotton locks onto the cage.
Figure 3:
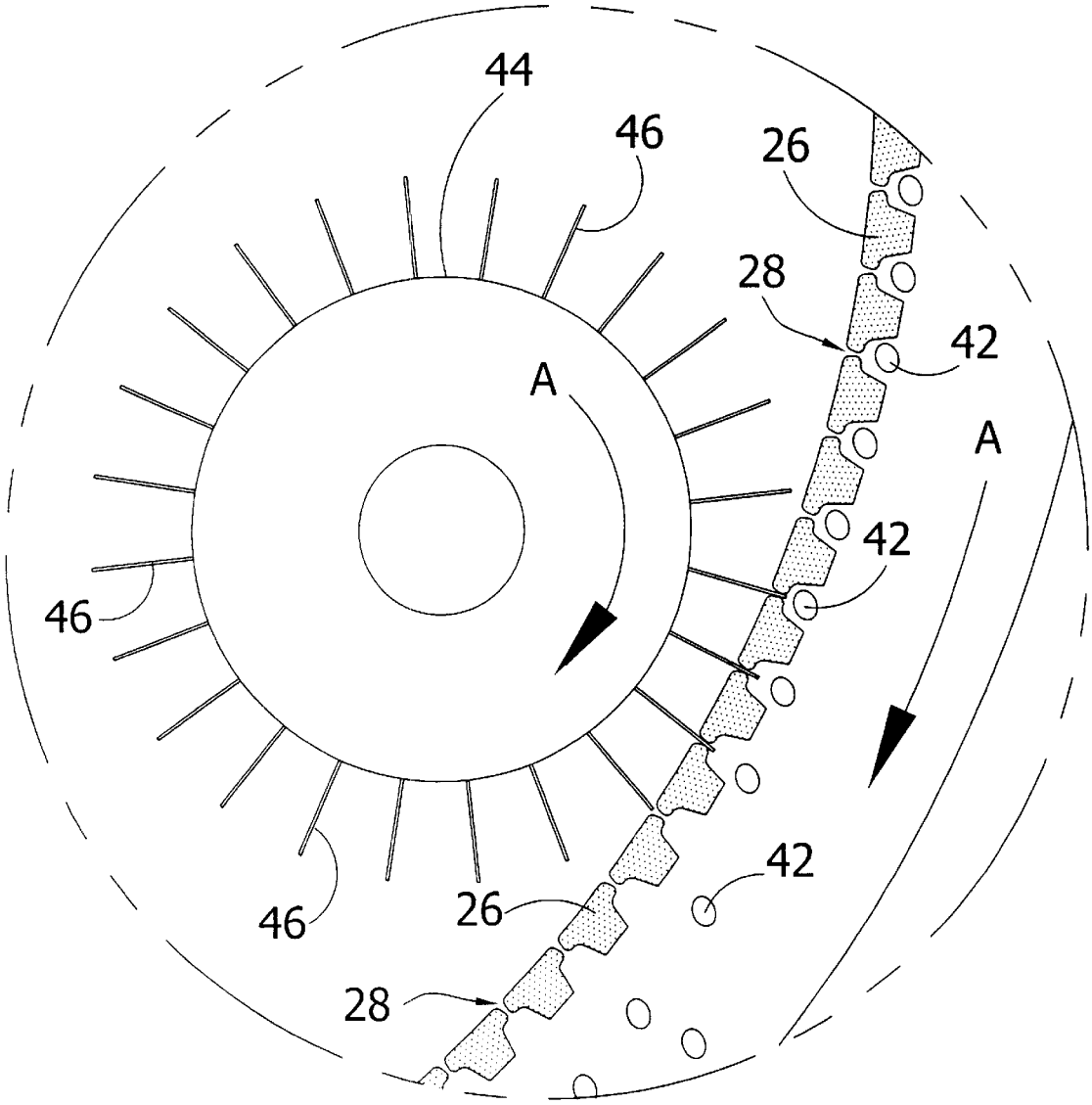
FIG. 3 is an enlarged sectional view of the lower right portion of the revolving cage illustrating the action of the clearer cylinder ejecting seeds and foreign matter from the slots between the cage sifting bars.

As the rigid cage rotates in a direction A illustrated in FIGS. 1 and 2, the fibers 15 of the seed cotton locks 14 will partially project through the slots 28 between the sifting bars 26 as they approach the position where a secondary driving assembly 35 rotates a fiber-engaging cylinder 34 in a second direction B (see FIG. 1). The perimeter of the fiber-engaging cylinder 34 contacts the interior surfaces of sifting bars 26. The force of the fiber-engaging cylinder 34 onto the sifting bars 26 is predetermined and caused by at least one hydraulic cylinder 36 that may be positioned at either end (or both ends) of the fiber-engaging cylinder 34.

Moreover, the surface of the fiber-engaging cylinder 34 of the present invention is fibrous, while the inner surface of each sifting bar 26 is a smooth and polished surface. Each sifting bar 26 is preferably made of a hard metallic material, while other materials having similar properties may be incorporated into the present invention. Since cotton fibers cling vigorously to other fibrous surfaces when pressed against them, the fibrous surface of the fiber-engaging cylinder 34 has a very high coefficient of friction against cotton fibers 14. In contrast, selective fibrous surfaces have very little adherance to smooth surfaces. As a result, the fibrous outer surface of the fiber-engaging cylinder 34 will have a relatively low coefficient of friction against the smooth inside surfaces of sifting bars 26. Moreover, the fiber-engaging cylinder 34 and the sifting bars 26 will have substantial life spans and they are economically refurbished. Additionally, the use of both the fiber-engaging cylinder 34 having a fibrous outer surface and also the series of smooth sifting bars 26 allows the present design to operate with reasonable power consumption and without generating excessive heat, which are common problems encountered by some of the previous cotton gin designs.

The preferred embodiment of the secondary driving assembly 35 includes an output drive shaft with pulley 70 that is connected to an additional countershaft and small pulley 72 via a secondary belt 74. Moreover, an auxiliary belt 76 extends from the small pulley 72 to engage pulley 78, which is connected to the fiber-engaging cylinder 34. Therefore, the secondary motor pulley 70 will generate the desired rotation (direction and speed) of the fiber-engaging cylinder 34.

Referring to FIG. 1, the relative opposite-rotating directions and speeds of the support rings 24 of the rigid cage 22 and fiber-engaging cylinder 34 are adjustably controlled by the primary driving assembly 32 and the secondary driving assembly 35. Consequently, the operator is able to vary the exposure distance of the individual sifting bars 26 with the surface of fiber-engaging cylinder 34, as desired for increased efficient operation. Such an arrangement optimizes the removal of the fiber 15 from the seed cotton locks 14 and improves ginning capacity by varying and minimizing the exposure of the surface of fiber-engaging cylinder 34 to the bare metal inside surfaces of sifting bars 26 as allowed by the ginning process. It should be understood that it is only necessary that the air current initially drawing the seed locks to the slot 28 draw a few fiber ends through the slots 28 sufficiently to entrap the fiber ends between the sifting bars 26 and the fiber-engaging cylinder 34. Once a few fibers are entrapped, the fiber-engaging cylinder 34 will draw in the adjacent fibers, which in turn draw in adjacent fibers until all of the fibers that may be reached from the pinch point are removed from the seed if the fiber-engaging cylinder 34 remains in contact with the sifting bars 26 sufficiently long.

Continuing to view FIG. 1, a blocking member (preferably including a blocking cylinder 38 having a series of fin projections 40 extending therefrom) is rotatably mounted external to the rigid cage 24 and proximate the exterior perimeter of the fiber-engaging cylinder 34. The blocking cylinder 38 rotates in direction A, and further optimizes the ginning rate by minimizing the direct exposure of the surface of fiber-engaging cylinder 34 with the inside surfaces of sifting bars 26. The position of the blocking cylinder 38 external to the rigid cage 24 and proximate the fiber-engaging cylinder 34 is adjustable to a predetermined clearance from the outside surfaces of sifting bars 26. The fin projections 40 of blocking cylinder 38 engage the seed cotton locks 14 that are projecting above a predetermined distance from the outside surfaces of the sifting bars 26. More specifically, the fin projections 40 engage the seed cotton locks 14 having fibers 15 that are not firmly clamped between fiber-engaging cylinder 34 and the inside surfaces of sifting bars 26. The fin projections 40 thereby engage the loose seed cotton locks 14 to knock them back into the bonnet housing 18 (see FIG. 1). Consequently, the seed cotton locks 14 will have another opportunity to engage the slots 28 between the sifting bars 26. Moreover, the rotational speed of blocking cylinder 38 is adjustable as desired by the operator to optimize the trajectory with which the rejected seed cotton locks 14 will reenter the bonnet housing 18. This will allow the rejected seed cotton locks 14 to seek out open slots 28 between the sifting bars 26 under the influence of the air currents drawn through the slots 28.

As the rigid cage 22 revolves, the sifting bars 26 will pass a contact point with the counter-rotating fiber-engaging cylinder 34 and the ginned seed 42 will typically be lying between adjacent sifting bars 26 (see FIG. 2). The sifting bars 26 of the rigid cage 22 will continue to transport the ginned seed 42 in direction A past a three o'clock position of the rigid cage 22, the ginned seed 42 will begin to drop out due to gravitational force. However, some of the ginned seed 42 and other foreign objects (such as spindle twists) may be wedged between adjacent sifting bars 26. As a result, a clearer assembly including a clearer cylinder 44 with a series of fins 46 attached thereto is mounted within the sifting bars 26 of the rigid cage 22 (see FIG. 3). The clearer fins 46 of the clearer cylinder 44 extend radially from the perimeter of the clearer cylinder 44 and traverse the slots 28. Therefore, the clearer cylinder 44 is powered only by the gear-like rotation of the clearer fins 46 that traverse the slots 28 between adjacent sifting bars 26, and will be drawn in direction A by the rigid cage 22. The clearer fins 46 will further eject the remaining ginned seeds 42 and foreign objects wedged between adjacent sifting bars 26 as they engage the slots 28. The ginned seed 42 and foreign matter will drop down onto an inclined surface 48, which further directs the ginned seed to slide down into a conveyor (not illustrated). The conveyor carries the ginned seed 42 either to seed storage or to a seed reclaimer (not illustrated) that is well known in the industry. The reclaimer will return the partially ginned seed 42 back into the ginning system for the additional removal of fiber 15.

Figure 4:
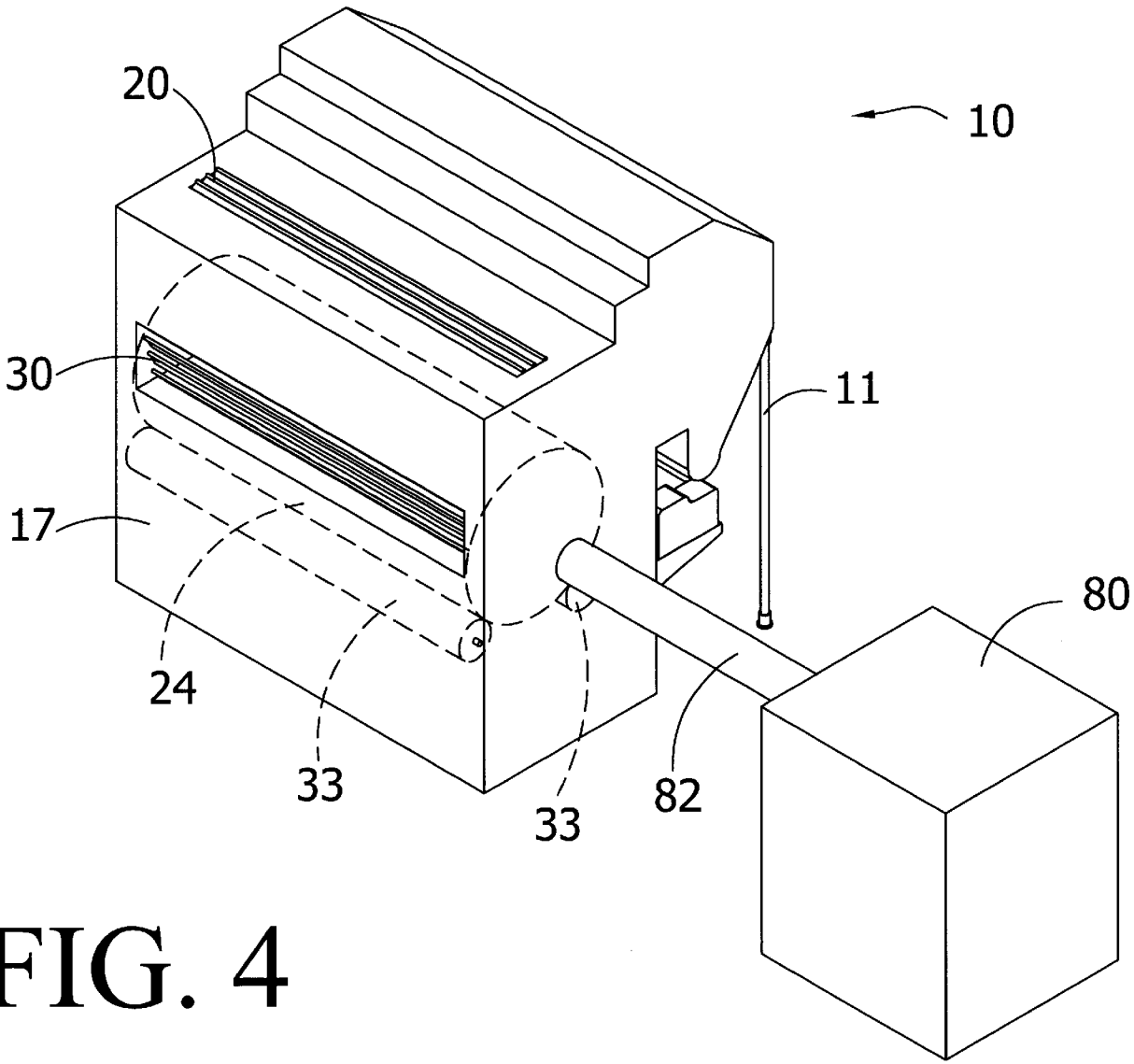
FIG. 4 is a perspective view of the rigid cage cotton gin of the present invention, with the rigid cage being illustrated in phantom.

Looking at FIG. 4, the air flows through the rigid cage 22 described earlier result from a suction fan or pump 80 whose inlet is connected by ductwork 82 to at least one open end of the support rings 24 of the rigid cage 22. This air flow into the rigid cage 22 through the slots 28 entrains the fibers 14, 15 pulled from the seeds 42 by the fiber-engaging cylinder 34 and conveys the fibers 14, 15 to a fiber collector (not illustrated) via the ductwork 82 and the suction fan/pump 80.

It can be further understood according to the above description and attached figures that it is desirable to have air flow through only a section of the periphery of the sifting bars 26 of the rigid cage 22. More specifically, it is desirable to have air flow into the rigid cage 22 through the slots 28 between the sifting bars 26 from approximately the nine o'clock position to the one o'clock position of the rigid cage 22, as illustrated in FIG. 1. To control the air flow according to these constraints, a stationary baffle 50 (FIG. 1) is included in the present invention. The stationary baffle 50 is mounted within the sifting bars 26 of the rigid cage 22, with the baffle 50 having seals 52*a,* 52*b,* and 53 at its extremities. Additional seals (not shown) seal the ends of the support rings 24 of the rigid cage 22. The baffle 50 and seals 52*a,* 52*b,* and 53 restrict the air flow into the sub-atmospheric area inside the sifting bars 26 of the rigid cage 22 to minimize horsepower requirements of the fan/pump 80 and to allow free release of the ginned seeds 42 after they pass the ginning point at substantially the one o'clock position, as illustrated in FIG. 1.

Thus, although there have been described particular embodiments of the present invention of a new and useful RIGID CAGE COTTON GIN, it is not intended that such references be construed as limitations upon the scope of this invention except as set forth in the following claims.

What is claimed is:

1. An apparatus for ginning seed cotton locks wherein cotton fibers are separated from cotton seed, said apparatus comprising:

a housing;

a pair of annular support rings rotatably mounted within said housing;

a plurality of sifting bars fixedly mounted in said support rings, said sifting bars having an interior surface and an exterior surface, said sifting bars being spaced apart in said supporting rings to form a plurality of slots;

feeding means for supplying the seed cotton onto said exterior surface of said sifting bars;

air flow means for creating a fluid flow inwardly past said support rings through said slots between said sifting bars, said air flow means positioned to draw cotton fibers through said slots;

a fiber-engaging cylinder rotatably mounted to said housing, said fiber-engaging cylinder having an external surface, said external surface of said fiber-engaging cylinder abutting said interior surface of said sifting bars to contact the fiber ends traversing said slot to draw the fibers through said slot;

wherein said external surface of said fiber-engaging cylinder has a first frictional resistance against the cotton fibers;

wherein said sifting bars have a second frictional resistance against the cotton fibers; and wherein said first frictional resistance is greater than said second frictional resistance to extract the cotton fibers from the cotton seed.

2. The apparatus as described in claim 1 in which said sifting bars are substantially trapezoidal, wherein the seed cotton is cradled between adjacent said sifting bars as drawn by said air flow means.

3. The apparatus as described in claim 1 wherein said air flow means comprises:

a vent traversing said housing creating said fluid flow within said housing toward said cylindrical cage, said airflow from said vent directing said seed cotton from said feeding means toward said cylindrical cage.

4. The apparatus as described in claim 3 further comprising:

a blocking cylinder rotatably mounted to said housing proximate said exterior surface of said sifting bars proximate said fiber-engaging cylinder; and a plurality of fin projections attached to said blocking cylinder, said fin projections striking the seed cotton locks positioned farther than a predetermined distance from said exterior surface of said sifting bars to expel the seed cotton locks into said airflow to thereby be redirected toward said sifting bars.

5. The apparatus as described in claim 1 further comprising a rotating clearer member mounted in said housing proximate said interior surface of said sifting bars, said clearer member including a clearer cylinder with a plurality of clearer fins extending radially from said clearer cylinder, wherein said clearer fins engage said each slot between said sifting bars in a gear-like relationship to eject any material positioned between said sifting bars.

6. The apparatus as described in claim 1, wherein said airflow means further comprises:

an air pump; and an air duct connected between said air pump and said interior surface of said cylindrical cage, said air pump further inducing said fluid flow through said slots into said cylindrical cage.

7. The apparatus as described in claim 1 further comprising:

a primary driving assembly connected to said support rings to rotate said support rings.

8. The apparatus as described in claim 1 further comprising:

a secondary driving assembly connected to said fiber-engaging cylinder to rotate said fiber-engaging cylinder.

9. The apparatus as described in claim 1 in which said external surface of said fiber-engaging cylinder includes an integral fibrous surface, wherein said fibrous surface of said fiber-engaging cylinder provides said first frictional resistance against the cotton fibers to draw the cotton fibers between said sifting bars.

10. The apparatus for ginning seed cotton locks as described in claim 1, wherein said sifting bars are contoured and spaced apart a distance to restrain the seeds of the seed cotton from coming within a distance of less than 13 millimeters from said interior surface when the seed is located over said slot.

11. The apparatus for ginning seed cotton locks as described in claim 1 wherein said interior surfaces of said sifting bars form a cylindrical surface, wherein said interior surface of each said sifting bar has a predetermined width to control the distance of contact between said fiber-engaging cylinder and the cotton fiber as said support rings rotate.

12. An apparatus for removing cotton fibers from seed cottons comprising:

a housing;

a cylindrical cage rotatably mounted in said housing, said cylindrical cage including a plurality of support rings and a series of sifting bars fixedly mounted within said support rings, said sifting bars spaced apart to define a series of slots, said sifting bars having an inner surface and an outer surface;

a pump linked to said cylindrical cage to cause a fluid flow inwardly through said slots of said cylindrical cage, said fluid flow at least partially drawing the cotton fibers through said slots; and a fiber-engaging cylinder rotatably mounted within said cylindrical cage, said fiber-engaging cylinder including an external integral fibrous surface in sliding contact with said inner surface of said series of sifting bars to engage the cotton fibers; and wherein said fiber-engaging cylinder draws the cotton fibers through said slots between said sifting bars.

13. The apparatus as described in claim 12 in which said sifting bars are substantially trapezoidal, wherein the seed cotton is cradled between said adjacent surfaces of said sifting bars as drawn by said pump.

14. The apparatus as described in claim 12 further comprising:

a blocking cylinder rotatably mounted to said housing proximate said exterior surface of said cylindrical cage; and a plurality of projections attached to said blocking cylinder to engage the seed cotton locks not positioned between said sifting bars.

15. The apparatus as described in claim 12 further comprising a rotating clearer member mounted in said housing proximate said interior surface of said sifting bars of said cylindrical cage, said clearer member including a clearer cylinder with a plurality of clearer fins extending from said clearer cylinder, wherein said clearer fins engage said slots between said adjacent sifting bars in a gear-like relationship to eject seed therefrom.

16. The apparatus as described in claim 12 wherein said inner surfaces of said sifting bars form a uniform cylinder, the width of said sifting bars determining the contact distance between said fiber-engaging cylinder and said inner surfaces of said sifting bars as said support rings rotate.

17. A cylindrical cage cotton gin for separating cotton fibers from cotton seed in a seed cotton lock, said cylindrical cage cotton gin comprising:

a seed cotton feeder delivering the seed cotton locks;

a bonnet housing proximate said seed cotton feeder;

a cylindrical sieve rotatably mounted proximal said bonnet housing, said cylindrical sieve having an outer surface and an interior surface, with a plurality of slots traversing said cylindrical sieve from said outer surface to said interior surface;

fluid pump means for generating fluid flow through said slots from said outer surface, wherein said fluid flow draws the seed cotton delivered from said cotton feeder to said outer surface of said cylindrical sieve, wherein the ends of the fibers of the seed cotton traverse said slots; and a fiber-engaging cylinder having an exterior surface, said fiber-engaging cylinder rotatably mounted within said cylindrical sieve, wherein said exterior surface of said fiber-engaging cylinder abuts said interior surface of said cylindrical sieve;

wherein said interior surface of said cylindrical sieve has a first frictional resistance against the cotton fibers;

wherein said external surface of said fiber-engaging cylinder has a second frictional resistance against the cotton fibers; and wherein said second frictional resistance is greater than said first frictional resistance to draw the cotton fiber through said slots when said exterior surface of said fiber-engaging cylinder and said interior surface of said cylindrical sieve rotate at different surface speeds.

18. The apparatus as described in claim 17 further comprising:

a blocking cylinder rotatably mounted to said housing proximate said outer surface of said cylindrical sieve; and a plurality of projections attached to said blocking cylinder, said projections colliding with the seed cotton locks positioned more than a predetermined distance from said outer surface to direct the seed cotton locks to redistribute on said outer surface.

19. The apparatus as described in claim 17 further comprising a rotating clearer member mounted inside said cylindrical sieve proximate said interior surface of said cylindrical sieve, said clearer member including a clearer cylinder with a plurality of clearer projections extending from said clearer cylinder, wherein said clearer projections engage said slots in said cylindrical sieve in a gear-like relationship to eject any material positioned in said slots of said cylindrical sieve.

20. The apparatus as described in claim 17 wherein said fluid pump means further communicates with vents in said bonnet housing to create air currents through said slots of said cylindrical sieve to distribute the seed cotton evenly on said outer surface of said cylindrical sieve and draw the ends of the cotton fibers through said slots.

21. The apparatus as described in claim 17 in which said exterior surface of said fiber-engaging cylinder includes an integral fibrous surface, wherein said integral fibrous surface of said fiber-engaging cylinder has a very high coefficient of friction when pressed against cotton fibers, but a low coefficient of friction when pressed against said interior surface of said cylindrical sieve.

22. The apparatus as described in claim 17 wherein said slots are substantially parallel to the axis of said cylindrical sieve and are spaced apart circumferentially to determine the contact distance between said fiber-engaging cylinder and said interior surface of said cylindrical sieve as said cylindrical sieve rotates.

23. A method for processing seed cotton locks by removing cotton fibers from a cotton seed, the method comprising the steps of:

a. providing a cylindrical sieve rotatably mounted in a housing, said cylindrical sieve having an outer surface and an inner surface with apertures therebetween;

b. discharging the seed cotton locks into said housing onto said cylindrical sieve aided by air currents passing inwardly through said apertures, wherein the ends of a portion of the fibers traverse said apertures;

c. slidably engaging said inner surface of said cylindrical sieve with a fiber-engaging cylinder having an integral fibrous outer surface;

d. engaging the cotton fiber traversing said apertures of said cylindrical sieve with said fiber-engaging cylinder; and e. blocking the central movement of the cotton seed using a restricted size of said apertures to separate the cotton fiber from the cotton seed.

24. The method as described in claim 23, wherein after step (b) further comprising the step of:

directing said seed cotton locks onto said cylindrical sieve using an airflow from at least one air vent traversing said housing.

25. The method as described in claim 23 wherein step (d) further comprises the step of:

engaging said cotton fibers with said fiber-engaging cylinder having a high coefficient of friction against said cotton fibers and a low coefficient of friction against said inner surface of said cylindrical sieve.

26. The method as described in claim 23, herein after step (e) further comprising the step of:

at least partially traversing said apertures with projections extending from a clearer cylinder entering said apertures from said inner surface to dislodge cotton seed from said apertures.

* * * * *